United States Patent [19]

Majumdar

[11] 4,115,968

[45] Sep. 26, 1978

[54] FRAME AND SEAL ASSEMBLY

[75] Inventor: Asit Majumdar, Saddle Brook, N.J.

[73] Assignee: Pioneer Industries, Div. of Core Industries Inc., Carlstadt, N.J.

[21] Appl. No.: 862,658

[22] Filed: Dec. 20, 1977

Related U.S. Application Data

[63] Continuation of Ser. No. 743,056, Nov. 18, 1976.

[51] Int. Cl.[2] ..... E06B 1/04; E06B 7/16

[52] U.S. Cl. ..... 52/204; 49/498; 49/504

[58] Field of Search ..... 52/204; 49/498, 504, 49/505

[56] References Cited

U.S. PATENT DOCUMENTS

| | | | |
|---|---|---|---|
| 2,737,412 | 3/1956 | Smith et al. | 49/498 X |
| 2,969,252 | 1/1961 | Gruver | 49/498 X |
| 3,309,817 | 3/1967 | Fisher | 49/498 X |
| 3,388,502 | 6/1968 | Ceyer et al. | 49/498 X |
| 3,656,260 | 4/1972 | Weaver et al. | 49/498 X |

FOREIGN PATENT DOCUMENTS

| | | | |
|---|---|---|---|
| 1,478,885 | 3/1967 | France | 49/504 |
| 1,509,380 | 8/1969 | Fed. Rep. of Germany | 49/505 |
| 1,509,435 | 1/1969 | Fed. Rep. of Germany | 49/504 |
| 584,410 | 10/1958 | Italy | 49/504 |

*Primary Examiner*—J. Karl Bell

*Attorney, Agent, or Firm*—Amster, Rothstein & Engelberg

[57] ABSTRACT

The invention provides a sealing strip and a frame, for instance a door frame, for use therewith. The frame includes a groove, to receive the strip, which is integrally formed in the material of the frame and which is so positioned and orientated that the strip is retained in an optimum position for firm contact by, and sealing with a closure, such as a door, to provide a barrier against passage therethrough of moisture, foreign matter, sound and heat.

13 Claims, 6 Drawing Figures

FIG. 2
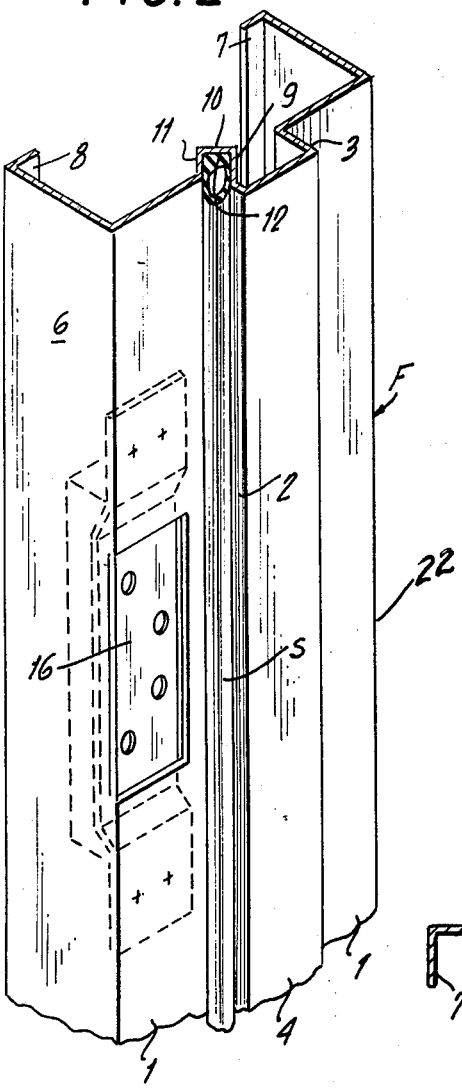
FIG. 3
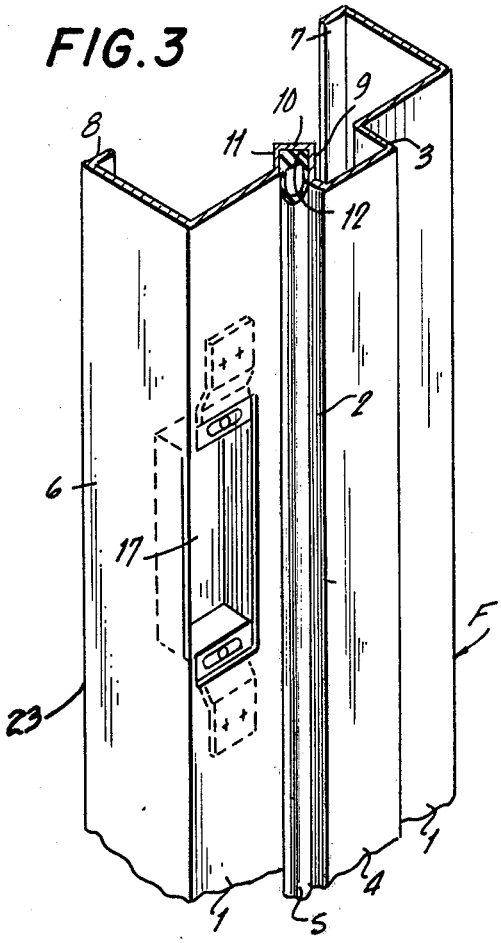
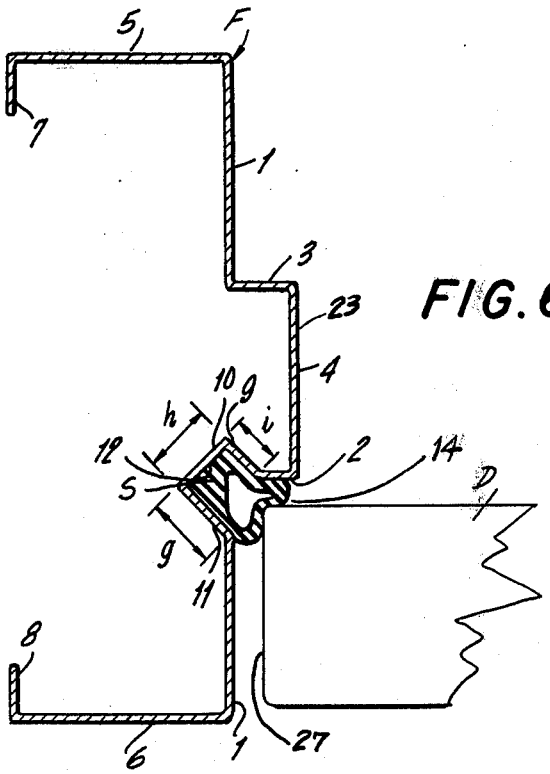
FIG. 6

FRAME AND SEAL ASSEMBLY

This is a continuation, of application Ser. No. 743,056 filed Nov. 18, 1976.

This invention relates to a sealing strip for use in an improved frame and an assembly of such frame and seal, especially for door and other hinged closure frames.

BACKGROUND OF THE INVENTION

There is a need in industry to provide economic and effective weatherproof, leakproof and soundproof barriers between closures and frames therefor, e.g. doors and door frames.

The presently available methods of providing such a barrier are:

1. Compressible seals applied to the frame with adhesives. This barrier cannot be adjusted after it is applied and the bond deteriorates with time and use as well as by weathering action on the adhesive.

2. Seals housed in separate metal retainers, and applied to the frame with screws, either at the factory or in the field. Factory application necessitates costly and difficult field positioning to ensure proper surface contact with the closure, and field application requires skill and is costly as well as difficult.

3. Flexible sealing strip interlocked into the frame through slots pierced through the frame. These seals must be applied, with special tools, prior to the installation of the frame. Only in this manner can the contractor insure that the concrete grout does not plug up the slots in the frame. At this point the contractor must either paint around or over the applied gasketing, or remove the gasketing, paint the frame, and replace the seals. This is a very costly procedure.

OBJECTS OF THE INVENTION

It is broadly an object of the present invention to provide a frame, for use in a closure and frame structure in combination with a novel sealing means which is self-mounted within the frame to provide a seal between the frame and the closure which prevents the passage therethrough of moisture, foreign matter, sound and heat.

A second object of the invention is to provide an improved form of sealing strip, adapted for use in such a frame.

A third object of the invention is to provide an assembly of such a frame and such a strip which provides a superior barrier against weather, leakage and sound, and by the use of fewer components and with economic savings and easier application than was possible hitherto.

SUMMARY OF THE INVENTION

According to a first aspect of the present invention, in a frame, for use with a closure having a front face and an edge face meeting at an angle, including:

i. a first wall bounding an opening to be closed by the closure ii. a second wall disposed at an angle to said first wall and extending inwardly of the opening to overlie the front face of the closure when the closure is in closed condition, there is provided the improvement which comprises the combination of a:

groove-defining wall means having opposed longitudinal edges joining respectively to a longitudinal edge of said first wall and to a longitudinal edge of said second wall and bounding a groove which opens towards the closure.; with a sealing strip receivable in said groove or recess and projecting therefrom in engageable relationship with the door closure when the closure is in closed condition with the sealing strip having a cross-section including a retaining portion having the shape of a quadrilateral with three relatively perpendicular sides and a fourth relatively non-perpendicular side and a sealing portion having a thin wall segment substantially the shape of an involute of a circle with the radius of curvature of the involute being smallest at the intersection of the retaining portion and the sealing portion adjacent the first wall and greatest at the intersection of the retaining portion and the sealing portion of the seal adjacent the second wall.

According to a second aspect of the present invention, a sealing strip comprises an elongated element made wholly of a resiliently deformable material and including, when considered in section on a plane normal to the direction of elongation:

i. an substantially right trapezoidal-shaped first body portion of solid material ii. a second arched body portion extending from said first body portion and defining therewith an internal space, the internal face of said second body portion bounding said space having in order from one end adjacent to the first body portion to the other end adjacent to the body portion three surface portions of which the respective radius of curvature increases from the first to the second and from the second to the third.

BRIEF DESCRIPTION OF THE DRAWINGS

The above described as well as further objects, features and advantages of the present invention will be more fully understood by reference to the following detailed description of the presently preferred, but nonetheless illustrative, embodiment in accordance with the present invention when taken in conjunction with the accompanying drawings, wherein:

FIG. 2 is a perspective elevation of a portion of a side member of a door frame, to show positioning of the sealing strip adjacent to a hinge mount;

FIG. 3 is a perspective elevation of a portion of a side member of a door frame, to show positioning of the sealing strip adjacent to a latch plate housing;

FIG. 6 is a transverse section, to a smaller scale, through a portion of a door frame and a door in closed position to show sealing engagement and compression of the sealing strip on the strike side of the door frame.

DESCRIPTION OF THE PREFERRED EMBODIMENTS

Figure 1:
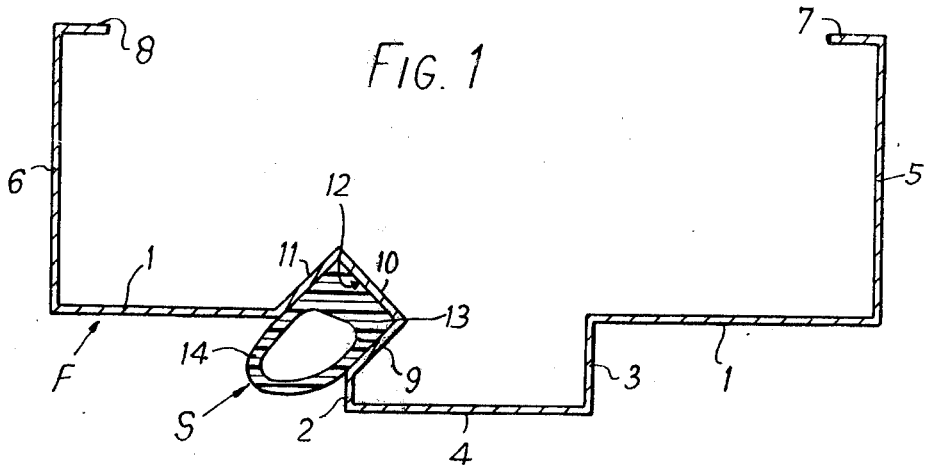
FIG. 1 is a transverse section through a portion of a metal door frame, showing a sealing strip positioned in a groove in the frame.

Referring to FIG. 1, there is shown a portion of a door frame designated generally by reference "F", and a sealing strip designated generally by reference "S".

This figure is a transverse section which may be taken at any point along each of the two side members and also the top and bottom cross members of a rectangular door frame.

The frame F is a metal member including a plane wall or door rabbet 1 from which plane elements or stop walls 2, 3 project at right angles to carry a plane element 4. At the longitudinal edges of the plane wall 1 there are walls 5 and 6 which terminate, remote from the wall 1, in flanges 7 and 8. The material of the door frame is, for example, 16 gauge metal sheet.

In the angle defined between the wall 1 and the element 2 there is positined a set of three integral walls 9, 10 and 11 which together bound three sides of a groove or recess 12. The walls 9 and 11 are both at right angles to the wall 10, and are respectively at 45° to the element 2 and the wall 1. In a preferred door frame, the groove 12 is continuous round the top and two side portions of the rectangular frame. It will be seen that the frame need not be pierced with holes or slots for retention of the strip.

Figure 5:
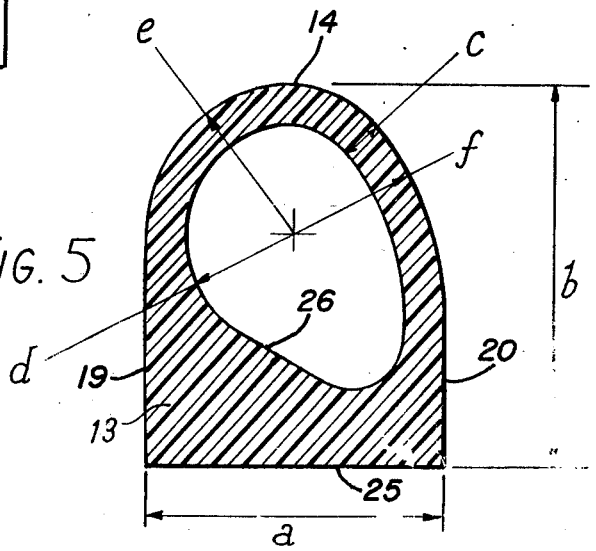
FIG. 5 is a transverse section of the sealing strip, to an enlarged scale, to show details of its external and internal shaping.

Partially within the groove 12 there is disposed the resiliently deformable sealing strip or seal S the structure and shaping of which is described in greater detail in relation to FIG. 5. The shape and orientation of the groove are designed to allow maximum compression against the door.

The sealing strip has a substantially right trapezoidal-shaped body portion 13, the opposed substantially parallel sides 19, 20 of which are fitted snugly into the rectangular groove 12, and an arched body portion 14 which projects from the groove into a zone which, when the door D is fully closed in the frame (see FIG. 4) is occupied by a corner portion of the door, thereby resulting in very firm contact between the door and the sealing strip, with resilient deformation of the strip. The seal protrudes from the groove just enough to provide optimum compression forces required for an effective sealing action at the hinged side of the door shown in FIG. 4, a portion of the arched body portion 14 of sealing strip S is compressed between the hinged side 21 of the Door and the plain wall or door rabbet 1.

The sealing strip S is made of any suitable resiliently deformable material, but the preferred materials are natural rubber or the material commercially available under the Trade Mark "NEOPRENE", e.g. ASTM designated SCE 42 Neoprene. The seal design thus incorporates the advantage of a completely sealed-in space, as well as a smooth exterior wall to minimize sound penetration.

The sealing strip may be retained in the groove 12 merely by being pressed firmly into position and thus held by its own coefficient of friction between the opposed substantially parallel sides 19, 20, of the sealing strip S and to the frame, and/or by slight resilient deformation of the solid portion 13 with respect to the groove, e.g. the sealing strip may be manufactured slightly oversize with respect to the groove 12. Alternatively, or in addition, the sealing strip may have an adhesive connection to the frame, or be bonded thereto. Where adhesive is used, preferably it is a dryback adhesive, or a contact cement used in conjunction with a cooperating layer on the frame.

Referring now to FIG. 2, it is seen that the sealing strip S can continue unbroken along the frame past the position occupied by hinges which would be secured to a plate 16 inside hinged frame section 22, so that there is no gap left unsealed when the door is closed.

FIG. 3 similarly shows how the sealing strip S can continue unbroken along the side strike frame section 23 past the position occupied by the usual latch plate housing or strike assembly 17, again so that there is no gap left unsealed when the door is closed.

Referring now to FIG. 5, there is shown, on a larger scale, a cross-section of a preferred embodiment of sealing strip S. In a practical construction, suitable for use on a door frame, such a strip could have the following dimensions:

"*a*" = width of body = half inch
"*b*" = height of body = five-eighths inch
"*c*" = wall thickness = one-sixteenth inch
"*d*" = radius of curvature of three-eighths inch
"*e*" = radius of curvature = half inch
"*f*" = radius of curvature = one inch The front of the seal features a unique bullnose shape utilizing multiple curvatures with centers oriented in such a manner as to assure positive surface contact between door edge and seal at all times, from contact to full compression, as well as to allow the seal to compress into air space within it. No field adjustments are required to achieve this.

Figure 4:
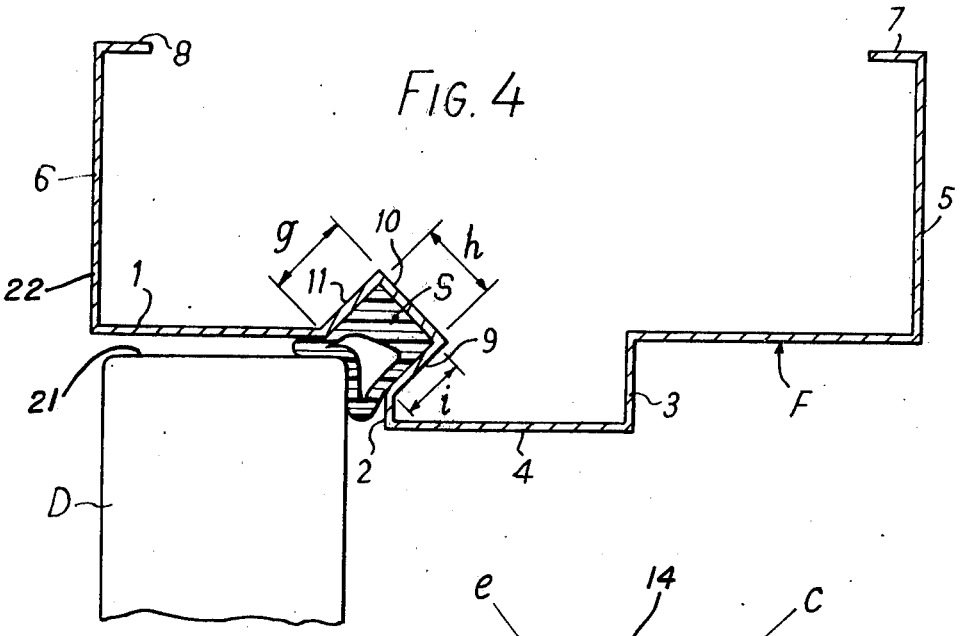
FIG. 4 is a transverse section, to a smaller scale, through a portion of a door frame and a door in closed position, to show sealing engagement and compression of the sealing strip on the hinged side of the door.

In FIG. 4, the corresponding dimensions of the frame would be:

"*g*" = half inch
"*h*" = seven-sixteenths inch
"*i*" = seven-sixteenths inch

This Figure shows the engagement of the corner of door D with sealing strip S and the compression of a portion of sealing portion 14 of the seal between door edge 21 and rabbet 1 on side hinge frame section 22. Likewise, FIG. 6 shows the engagement of the corner of the door D and the inner flat surface of the door with a portion of the sealing portion 14 of the seal and the compression of a portion of the sealing portion 14 the inner door surface and stop wall 2 on the side strike frame section 23. The difference in characteristics between the seal effected between the door and the side frame sections 22, 23 result from the difference in the approach angle between door edge 21 and side frame section 22, 23 resulting from the different distances between door edge 21 and door edge 27 from the hinge mounted in plate 16. Although it is not shown, the sealing strip S will assume substantially the orientation shown in FIG. 6 along the interface between the door corner and the top frame section.

As fully shown in FIG. 5, the cross-section of sealing strip S is best described by describing the solid body portion 13 and the arched body portion 14 separately. The solid body portion or retaining portion 13 of the sealing strip S has a cross-section which is substantially a right trapezoid having two, opposed substantially parallel sides 19, 20 connected by a base 25 perpendicular relative thereto and a fourth, non-perpendicular side 26. The cross-section of the arched body portion or sealing portion 14 of the sealing strip S is a narrow, generally arcuate band 14, extending from the first substantially parallel side 19 in the shape of an involute of a circle terminating at the second substantially parallel side 20. The radius of curvature of the involute shaped arched body portion 14 is smallest at the intersection with parallel wall side 19 and largest at the intersection with parallel side 20.

The thickness of the cross-section of arched body portion 14 is approximately 1/16 inch.

The inner surface of arched body portion 14 and the non-perpendicular side 26 of the solid, retaining portion 13 defines an air space that is asymmetrical about the vertical axis as oriented in FIG. 5.

The sealing strip S is placed in the three sections of the door frame assembly, including the side hinged frame section 22 (FIGS. 2, 4), the side strike frame section 23 (FIGS. 3, 6) and the top frame section (not shown) in such orientation that the non-parallel side 26 of the solid retaining portion 13 of sealing strip S is substantially parallel to the surface of the first wall or rabbet 1.

The asymmetrical shape of sealing strip S provides the necessary flexibility to assure that the seal will engage a corner of the door D in the manner substantially shown in FIGS. 4 and 6 without the compression of the sealing portion 14 preventing the door from fully closing or requiring unnecessary force to effect a complete closure. However, as shown in FIG. 5, the gasket has a sufficient height *b* to assure that in those situations where, due to tolerance buildup or other variables, there is a larger than expected space between rabbet 1 and door edge 21 or the inner flat surface of door D and plane element or door stop 2 assuring a complete seal in all conditions.

The embodiments of frame and sealing strip as described have the following advantages:

1. The seal housing is integral to a part of the door frame, and is therefore vandal proof;
2. use of screws, which can loosen with time and use, is eliminated.
3. use of adhesives which can deteriorate with time and weather is eliminated;
4. the diagonal orientation of the groove 12 with respect to the plane of the door assures maximum contact and compression of the strip;
5. the design of the sealing strip assures that the strip will compress into its own internal pocket, and not merely by compression of its own material, thus avoiding damage to the strip;
6. the direction of compression acts to assure continuous seating pressure towards the groove;
7. the efficient combination of integral groove and seal design imparts excellent sound retardation properties;
8. the seal can be inserted effortlessly into the groove without the use of any special tools and can be quickly replaced when required, and no adjustments are required because full compression is assured automatically by the design combinations used;
9. the sealing strip retains weatherproof characteristics indefinitely, as compared with (i) separate screwed-on seals and retainer systems which become loose after repeated use due to door pressure against the seals or (ii) glued-on seals where the adhesive can work loose from the same pressures, age and weather;
10. the compressible seal can be applied either in the factory on finish painted material, or field-applied after installation and finish painting;
11. snug fit of the gasket in the frame groove;
12. optional use of adhesive;
13. ease of application in the plant or in the field;
14. approval for application in a fire wall;
15. very competitive cost in comparison with door frames using non-integral weatherproofing gaskets.

A latitude of modification, change and substitution is intended in the foregoing disclosure. Accordingly, it is appropriate that the appended claims be construed broadly and in a manner consistent with the spirit and scope of the invention.

I claim:

1. In a frame for use with a door closure adapted to be moved between an open and a closed position including a frame section having a cross-section formed of a rabbet and an intersecting stop wall perpendicularly disposed thereto, the improvement comprising: the combination of a recess extending the entire length of said frame section with the cross-section of said recess symmetrically disposed about a medial plane of said recess bisecting said intersection of said rabbet and said stop wall, said recess defined by a pair of side walls disposed on either side of said medial plane substantially parallel to said medial plane and an end wall substantially perpendicular thereto connecting said side walls with said recess opening towards said closure; with a seal receivable in said recess and projecting therefrom in engaging relationship with said door closure when said door closure is in said closed position, said seal having a cross section including a solid retaining portion having the shape of a quadrilateral with three relatively perpendicular sides and a fourth relatively non-perpendicular side and a sealing portion having a narrow arcuate segment extending from a first substantially parallel side of said quadrilateral to a second substantially parallel side having substantially the shape of an involute of a circle with a radius of curvature of said involute being smallest at an intersection of said retaining portion and said sealing portion where said first substantially parallel side of said retaining portion is adjacent said door rabbet and greatest at an intersection of said retaining portion and said sealing portion of said seal where said second substantially parallel side of said retaining portion is adjacent said stop wall whereby said segment of said sealing portion having the smallest radius of curvature first comes into engaging relationship with said door closure as said door closure is moved from said open position to said closed position but before said closed position is reached.

2. The combination as recited in claim 1 wherein said thin wall segment of said sealing portion of said seal and said fourth relatively non-perpendicular side of said quadrilateral define an air space having a non-symmetrical cross section.

3. The combination as recited in claim 1 wherein said fourth relatively non-perpendicular side of said quadrilateral is substantially colateral with said door rabbet.

4. The combination as recited in claim 1 further including hinge receiving means located in said door rabbet of said frame section remote from said recess therein wherein said seal in said recess extends continuously along the entire length of said frame section.

5. The combination as recited in claim 1 further including strike means located in said door rabbet of said improved frame section remote from said recess whereby said seal in said recess extends continuously along the entire length of said frame section.

6. The combination as recited in claim 1 further comprising a first side frame section vertically oriented including hinge means, a second side frame section vertically oriented including strike means and a third top frame section fixedly connecting said side hinge frame and said side strike frame at the top of said side frames thereby forming an inverted "U"-shaped assembly.

7. An improved seal adapted to be used in conjunction with a frame assembly for use with a closure having a side hinge frame section, a side strike frame section, and a top frame section connecting said side sections to form an inverted "U"-shaped assembly with each frame section having a cross section formed of a rabbet and an intersecting stop wall perpendicularly disposed thereto with a recess extending along the entire length of said frame section, the cross section of each of said frame sections having a recess symmetrically disposed about a medial plane of said recess bisecting said intersection of said rabbet and said stop wall and defined by a pair of side walls disposed on either side of said medial plane substantially perpendicular to said medial plane and an end wall substantially perpendicular thereto connecting said walls and opening towards said closure comprising:

a retaining portion of said seal, the cross section of which is a substantially right trapezoidal shaped quadrilateral having two parallel sides connected by a base perpendicular relative thereto and a fourth non-perpendicular side with said parallel sides of said quadrilateral engageable with said side walls of said recess retaining said seal within said recess; and a sealing portion of said seal, the cross section of which is a narrow generally arcuate band extending from one of said parallel sides of said cross section of said retaining portion to the second of said parallel sides thereby cooperating with said fourth side of said retaining portion to define an asymmetrical air space within said sealing portion.

8. An improved seal adapted to be used in conjunction with a closure frame assembly having a side hinge frame section, a side strike frame section and a top frame section connecting said side section to form an inverted "U"-shaped assembly and a closure having an inner lateral surface and a lock means projecting from a first end plane thereof and a second end plane hingedly mounted to said side hinge frame section moveable from a first open position with said lock means remote from said side strike frame section to a second closed position with said lock means in engagement with said strike means in said side strike frame section, each frame section having a cross-section formed of a rabbet and an intersecting stop wall perpendicularly disposed thereto with a recess opening towards said closure extending along the entire length of each of said frame sections, the cross-section of said recess symmetrically disposed about a medial plane of said recess bisecting said intersection of said rabbet and said stop wall and defined by a pair of side walls disposed on either side of said medial plane substantially parallel to said medial plane and an end wall substantially perpendicular thereto and connecting said side walls comprising:

a retaining portion of said seal, having a cross-section substantially a right trapezoid receivable in said recess between said pair of opposed substantially parallel sides and a sealing portion of said seal extending from said retaining portion constructed and arranged to engage said lateral surface of said door as said door is moved from said first open position to said second closed position and to become compressed by the engagement of said inner surface of said door against said sealing portion along the entire length of said seal in each of said frame sections when said door assumes said second closed position.

9. The seal as recited in claim 8 wherein the cross-section of said sealing portion is a continuous narrow strip extending from one of said pair of parallel sides of said retaining portion to said other parallel side thereby cooperating with a non-parallel side of said trapezoidal retaining section to define an asymmetrical air space within said sealing portion of said seal whereby said air space is partially collapsed by the engagement of said door with said sealing strip when said door is in said closed position.

10. The seal as recited in claim 8 wherein substantially the entire sealing portion of said seal in said side hinge frame is compressible between said second end plane of said door and said rabbet of said side hinge frame section when said door is in said second closed position.

11. The seal as recited in claim 10 wherein substantially the entire sealing portion of said seal in said strike frame section is compressible between said inner surface of said door adjacent said first end plane thereof and said stop wall of said side strike frame section when said door is in said second closed position.

12. The seal as recited in claim 10 wherein substantially the entire sealing portion of said seal in said top frame section is compressible between said inner surface of said door adjacent said top frame section and said stop wall of said top frame section when said door is in said second closed position.

13. The seal as recited in claim 8 wherein said seal is made from resiliently deformable material such as closed cell neoprene.

* * * * *